United States Patent [19]

Lin

[11] Patent Number: 4,983,119

[45] Date of Patent: Jan. 8, 1991

[54] MUSICAL CANDLE ACTUATED BY THERMISTOR SWITCH

[76] Inventor: Wen-Tsung Lin, P.O. Box 74-9, Taipei, Taiwan

[21] Appl. No.: 498,715

[22] Filed: Mar. 26, 1990

[51] Int. Cl.[5] ..... F23D 3/02

[52] U.S. Cl. ..... 431/253; 338/26; 338/13; 431/288; 431/289; 84/3

[58] Field of Search ..... 431/253, 288, 289, 125; 338/13, 22 R, 23, 24, 26, 30, 223, 224; 84/171, 2, 3

[56] References Cited

U.S. PATENT DOCUMENTS

| | | | |
|---|---|---|---|
| 3,537,053 | 10/1970 | Snoberger et al. | 338/26 x |
| 4,477,249 | 10/1984 | Ruzek et al. | 431/253 |
| 4,496,930 | 1/1985 | Krecisz et al. | 338/26 |
| 4,568,269 | 2/1986 | Lin | 431/253 |
| 4,804,323 | 2/1989 | Kim | 431/253 |

*Primary Examiner*—Larry Jones

[57] ABSTRACT

A musical candle includes a longitudinal thermistor strip emedded in a candle juxtapositional and proximate to a wick which thermistor can sensitively actuated when burning or extinguishing the candle for starting or stopping sounding of a musical device mounted in a casing for holding the candle on the casing.

4 Claims, 1 Drawing Sheet

MUSICAL CANDLE ACTUATED BY THERMISTOR SWITCH

BACKGROUND OF THE INVENTION

U.S. Pat. No. 4,477,249 disclosed by Ruzek et. al includes an optical fiber which extends a wick to a sensor and carries light from the flame for detection by the sensor upon a burning of the wick for sounding a music from a musical intergrated circuit provided in a bottom portion of the candle which however may be falsely operated for its sounding if under the exposure of a strong light, even the candle is not lit.

Tung Lin disclosed a musical candle in his U.S. Pat. No. 4,568,269 provided with a pair of electric conductors will be burned to melt and fuse together to close an electric circuit for sounding a musical device formed in the candle. Once burned and fused for connecting the two conductors, the electric switch of the sounding integrated circuit will be always closed for continuous music sounding even for after blowing off to extinguish forch of the burning candle.

The present inventor has found the drawback of the conventional candle which is precisely operated for easily starting or stopping of the musical candle.

SUMMARY OF THE INVENTION

The object of the present invention is to provide a musical candle including a candle mounted on a base casing, a longitudinal thermistor formed int eh candle juxtapositional and proximate to a wick of the candle, and a musical device formed in the casing, whereby upon a burning of the candle wick, the thermistor electrically connected to the musical device will be thermally conducted to close a power circuit of the musical device to sound a music memorized in the musical device, and upon a wind blowing to extinguish a flame of the burning candle, the thermistor will be deactuated to disconnect the power supplied to the musical device to immediately stop the music sounding.

DETAILED DESCRIPTION

Figure 1:
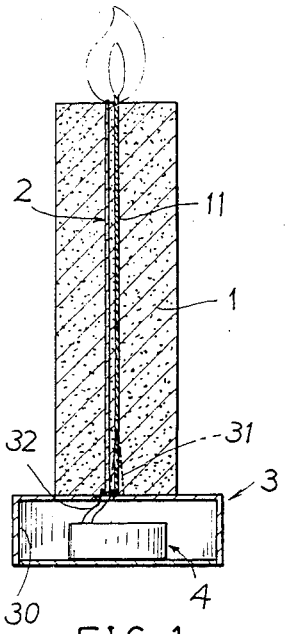
FIG. 1 is an illustrations of the present invention.

As shows is FIG. 1–4, the present invention comprises: a candle 1 having a wick 11 longitudinally formed therein through a full length of the candle 1, a longitudinal thermistor switch 2 formed in the candle 1 juxtapositional and proximate to the wick 11, a base casing 3 formed under the candle 1 for securing the candle 1 thereon, and a musical devide 4 mounted in the casing 3 electrically connected to the thermistor switch 2.

The candle 1 is fixed on the base casing 3 by engaging a needle member 31 of the base casing 3 into a bottom of the candle 1. The musical device 4 includes: a musical integrated circuit 41 (hereinafter called as musical IC), a power source 42 such as a battery, and a speaker 43 for sounding the music memorized is the musical IC 41.

The thermistor switch 2 has its two leading wires 23, 24 connected between the power source 42 and a trigger pin 411 of the musical IC 451 for on-off control of the IC 41.

Figure 2:
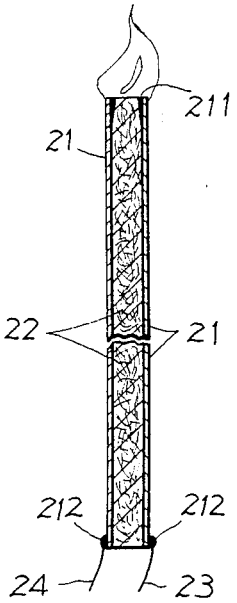
FIG. 2 shows the thermistor switch of the present invention.
Figure 3:
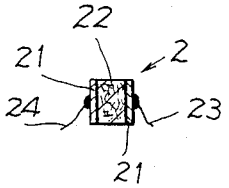
FIG. 3 is a cross sectional drawing of the thermistor switch of the present invention.

The longitudinal thermistor switch 2 as shows in FIGS. 1, 2, 3 includes a pair of longitudinal metal plates and separated with each other which metal plates are electrically conductive and electrically, conductive and oxidized to form metallic oxide when burned in the air, a laminated material layer 22 sandwiched between the pair of metal plates 21 for reinforcing the two metallic plates 21 thereon, and a pair of conducting or leading wires 23, 24 respectively connected is the two plates 21 by soldering each wire 23 or 24 to a bottom portion 212 of each said plate 21. The longitudinal metal plates 21 may be selected from: copper, manganese, nickel, cobalt, iron and chromium of the metallic oxides are thermally sensitive. And the metals can be oxideized in the air when burned. The laminated material 22 may be selected from an epoxy resin inpregnated glass fibers, or other bonding resin impregnated in glass fibers.

Figure 4:
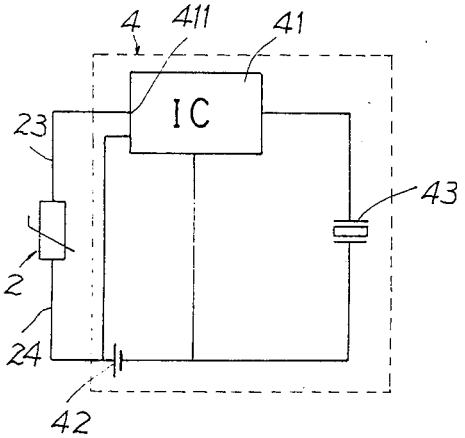
FIG. 4 is an electric circuit diagram of the musical device of the present invention.

In using the present invention, the wick 11 is burned at its top portion to also burn the resin material 22 laminated in between the two plates 21. The plate 21 is made of thin to be a thin plate, a foil or a thin film which is easily oxidized to be cupric oxide layer 211 if it is a copper plate, as shown in FIG. 2. The cupric oxide layer 211 is heated to increase its temperature, but gradually reducing its resistance during the burning of candle 1 and the resinous materials (Epoxy) 22 will be burned and removed so as to form a thermistor in situ. The thermistor thus formed will reduce its internal resistance below 100 kilo ohms whenever the candle 1 is being burned, thereby conducting an electric current from the power source 42 to the musical IC 41 for sounding the music through the speaker 43 as shown in FIG. 4.

Once the flame or torch of the burning candle 1 is extinguished by blowing air thereto, the thermistor 2 is cooled down to recover its original high resistance to disconnect the power supply of the musical IC 41, thereby stopping the music sounding. Even the thermistor 2 is burned from its uppermost end as shown in FIG. 2, a conducting current across through the two plates 21 will be led to the IC 41 and power source 42 through the two leading wires 23, 14 connected or soldered to the two plates 21. It may be doubted that a continuous burning of the thermistor 2 may break or damage the crastal lattice of the laminated material 22 and metal plates 21 to influence the thermal sensitive switching function of the present invention. Nevertheless, the logitudinal thermistor 2 is downwardly burned to always reveal a new ("fresh") laminated material layer to ensure a thermal sensitive effect for the present invention.

Figure 5:
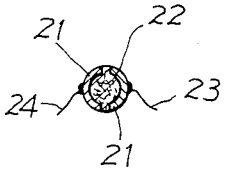
FIG. 5 is a cross sectional drawing of another preferred thermistor switch of the present invention.

The logitudinal thermistor switch 2 as shown in FIG. 2, 3 is shaped as a logitudinal strip, which however may be modified to be a rod shape as shown in FIG. 5, in which the two metallic plates 21 are circumferentially disposed around a laminated core rod 22. The shape, size and materials of the thermistor 2 are not limited in this invention. The resin material may be replaced with other binder materials.

The present invention has the following advantages superior to a conventional musical candle:

1. Only the burning of the candle can initiate the sounding of the musical IC of this invention so as to prevent a false operation such as a optical sensor being falsely actuated by a strong light.

2. The music can be optionally or randomly started or stopped merely by lighting the candle or putting off the candle flame.

3. Simpler construction of the sensor can be made in this invention since the logitudinal-strip shaped thermistor 2 of this invention can be premade in mass production and can be optionally cut to a desired length suitable for the insertion of a candle of any size.

What is claimed:

1. A musical candle comprising:

a candle having a wick longitudinally formed in said candle;

a base casing formed under said candle for holding said candle thereon;

a musical device having a musical integrated circuit and a trigger pin, mounted in said base casing and having a power source for powering said musical integrated circuit; and a longitudinal thermistor switch including a means for changing its internal resistance formed in said candle juxtapositional and proximate to said wick and electrically connected between said power source and said trigger pin of said musical integrated circuit of said musical device, whereby upon a burning of said wick and said thermistor switch, said thermistor switch is actuated to reduce its internal resistance to conduct a current from said power source for triggering and sounding said musical integrated circuit, and upon an extinguishing of a burning flame of the candle, the thermistor is cooled to recover its resistance to disconnect the power supply to said musical integrated circuit for stopping a music sounding.

2. A musical candle according to claim 1, wherein said logitudinal thermistor switch includes a pair of logitudinal metallic plates made of electrically conductive conductive and being oxidized when burned in air, a laminated material layer sandwiched between said pair of metallic plates having binder material impregnated in glass fibers for reinforcing the two metallic plates thereon, and a pair of leading wires respectively connected to each bottom portion of each said metallic plate to be electrically connected between said power source and said musical integrated circuit of said musical device.

3. A musical candle according to claim 2, when said metallic plate is a thin plate, a foil or a thin film selected from the group consisting of copper, iron, manganese, nickle, cobalt and chromium.

4. A musical candle according to claim 2, wherein said binder material of said laminated material layer is a resinous material.

* * * * *